US005317847A

United States Patent [19]

Scairono

[11] Patent Number: 5,317,847

[45] Date of Patent: Jun. 7, 1994

[54] U-BLOCK REINFORCING SYSTEM

[76] Inventor: Barry J. Scairono, 4 Maple St., Gretna, La. 70053-7014

[21] Appl. No.: 758,770

[22] Filed: Sep. 12, 1991

[51] Int. Cl.[5] ..... E04B 5/52; E06B 1/04

[52] U.S. Cl. ..... 52/204.1; 52/433; 52/250

[58] Field of Search ..... 52/250, 433, 204, 709, 52/435, 98, 100, 724, 725, 326, 483, 486, 439, 204.1; 249/29, 30, 41

[56] References Cited

U.S. PATENT DOCUMENTS

| | | | |
|---|---|---|---|
| 947,590 | 1/1910 | Franson | 52/725 |
| 957,048 | 5/1910 | Francis | 52/733 |
| 1,158,197 | 10/1915 | Francis | 52/433 |
| 1,295,204 | 2/1919 | Pomerantz | 52/375 |
| 1,461,409 | 7/1923 | White | 249/29 |
| 1,670,462 | 5/1928 | Macomber | 249/30 |
| 1,738,614 | 12/1929 | Ritchie | 52/648 |
| 1,922,945 | 8/1933 | Gravert | 52/486 |
| 1,926,182 | 9/1933 | Sereff | 52/250 |
| 1,941,211 | 12/1933 | Inglee | 52/326 |
| 2,705,414 | 4/1955 | Rose . | |
| 2,854,842 | 10/1958 | Hosbein et al. . | |
| 3,070,851 | 1/1963 | Stephens | 52/509 |
| 3,450,427 | 6/1969 | Fischer . | |
| 3,995,825 | 12/1976 | Ward et al. | 249/41 |
| 4,177,616 | 12/1979 | Lampert | 52/509 |
| 4,422,275 | 12/1983 | Baetje | 52/509 |
| 4,628,657 | 12/1986 | Ermer et al. | 52/509 |
| 4,776,143 | 10/1988 | Pointner | 52/506 |

FOREIGN PATENT DOCUMENTS

| | | | |
|---|---|---|---|
| 917568 | 9/1954 | Fed. Rep. of Germany | 52/204 |
| 2038961 | 2/1972 | Fed. Rep. of Germany | 52/719 |
| 506798 | 8/1920 | France | 52/204 |
| 964231 | 1/1950 | France | 52/439 |
| 1181335 | 1/1959 | France | 52/503 |
| 52746 | 9/1922 | Sweden | 52/433 |

*Primary Examiner*—James L. Ridgill, Jr.
*Attorney, Agent, or Firm*—Pravel, Hewitt, Kimball & Krieger

[57] ABSTRACT

A steel truss (10) spanning an opening (11) in a load-bearing CMU wall (111) is used as a structural support from which to hang hangers (12) having steel plates (13) on their lower ends. U-blocks (14) are placed on the hangers, and the space (20) between adjacent U-blocks (14) is filled with mortar. After the mortar hardens (typically 24 hours later), the trench formed by the hollow areas (15) in the U-blocks is filled with concrete, thus encasing the steel truss (the height of the truss is less than the distance from the lower interior of the U-blocks to the bottom of the CMUs above the U-blocks) and forming a steel-reinforced structural beam across the opening (11). CMUs (17) are then laid on top of the structural beam to continue the load-bearing wall above the opening.

The truss preferably has attached at each end thereof a steel saddle (16) which serves to center the truss in the U-blocks.

25 Claims, 5 Drawing Sheets

U-BLOCK REINFORCING SYSTEM

BACKGROUND OF THE INVENTION

1. Field of the Invention

The present invention relates to masonry construction. More particularly, the present invention relates to a method of and apparatus for spanning openings in walls of masonry structures.

2. General Background of the Invention

When a doorway or other opening is needed in a building made of concrete masonry units (CMUs), usually one of two things is done. Either (1) a structural steel beam (such as an I-beam) is used to span the opening, with the CMUs later being laid on top of the structural steel beam, or (2) if one wishes not to have any exposed steel, one sets up a scaffolding or other form, lays U-blocks on the form, places reinforcing bars in the hollow part of the blocks, then fills the U-blocks with concrete, removing the forms after the concrete sets.

Using structural steel beams is disadvantageous in that the steel beams rust when exposed to the weather, so they must be frequently painted. The structural steel beams also expand and contract at a different rate from the masonry, often resulting in cracks in the masonry near the steel. The structural steel also tends to deflect more than the masonry can tolerate, unless the structural steel beam is made to be substantially taller or thicker, which makes it very heavy. Using a scaffolding is expensive and time consuming.

Therefore, it would be beneficial to provide a method of and apparatus for spanning openings in walls in masonry structures without the use of exposed structural steel and without the expense (in both time and money) of building a scaffolding.

SUMMARY OF THE INVENTION

The apparatus of the present invention solves the problems confronted in the art in a simple and straightforward manner. What is provided is a method and apparatus of spanning openings in walls in masonry structures without the use of exposed structural steel and without the use of scaffolding.

The present invention is as convenient as using a structural steel beam (such as an I-beam), yet does not use exposed structural steel. It is similar to method (2) above, but (A) with trusses replacing the reinforcing bars and, (B) unlike method (2) above, no form is needed.

The present invention uses a system including a truss and a number of hangers on which U-blocks are hung prior to and during the placement of mortar between and concrete in the U-blocks. The truss, which is preferably made of steel, is ultimately encased in concrete, so there is no exposed steel. The truss is strong enough to support the U-blocks, so no scaffolding is needed.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

PARTS LIST

Figure 1:
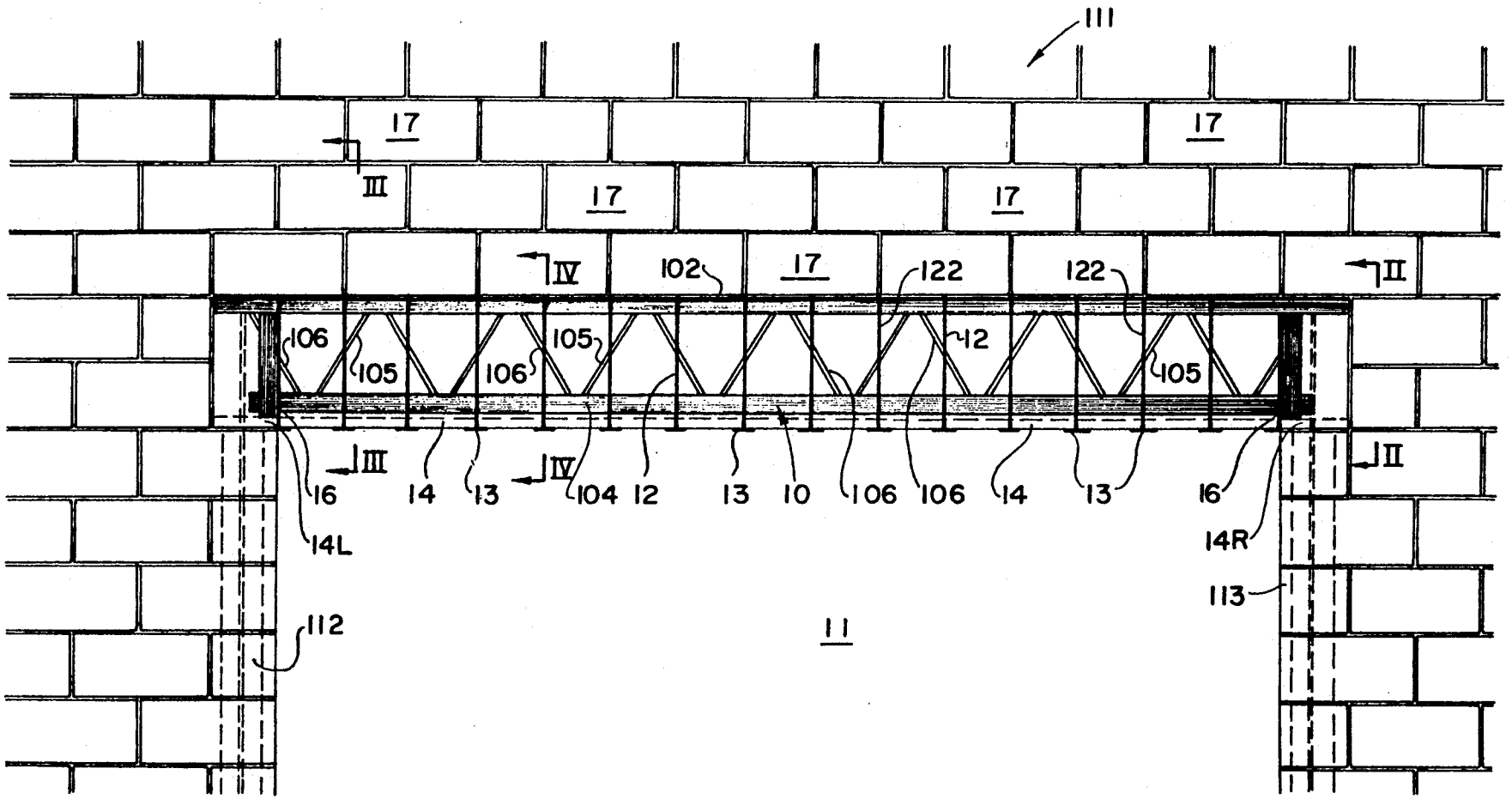
FIG. 1 is a front view of an opening spanned by the apparatus of the preferred embodiment of the present invention, with only an outline of the U-blocks being shown so that the apparatus of the present invention can be seen.

The following is a list of suitable parts and materials for the various elements of the preferred embodiment of the present invention.

10 truss, preferably steel
11 opening in wall 111
12 hangers, preferably steel
13 plates or bearing surfaces of various designs (can be customized on a job-by-job basis), preferably steel
14 concrete masonry U-blocks
14L concrete masonry U-block
14R concrete masonry U-block
15 hollow area in U-blocks 14
16 alignment saddle, preferably steel
17 concrete masonry units (CMUs)
18 mortar
20 space between adjacent U-blocks 14 (mortar filled)
101 right upper truss chord, preferably steel
102 left upper truss chord, preferably steel
103 right lower truss chord, preferably steel
104 left lower truss chord, preferably steel
105 right-slanting diagonal truss member, preferably steel
106 left-slanting diagonal truss member, preferably steel
111 wall
112 left side portion of wall 111
113 right side portion of wall 111
121 bends in hangers 12
122 substantially hook-shaped members of hangers 12
123 scores in hangers 12
124 holes
125 mortar

DETAILED DESCRIPTION OF THE PREFERRED EMBODIMENT

Figure 2:
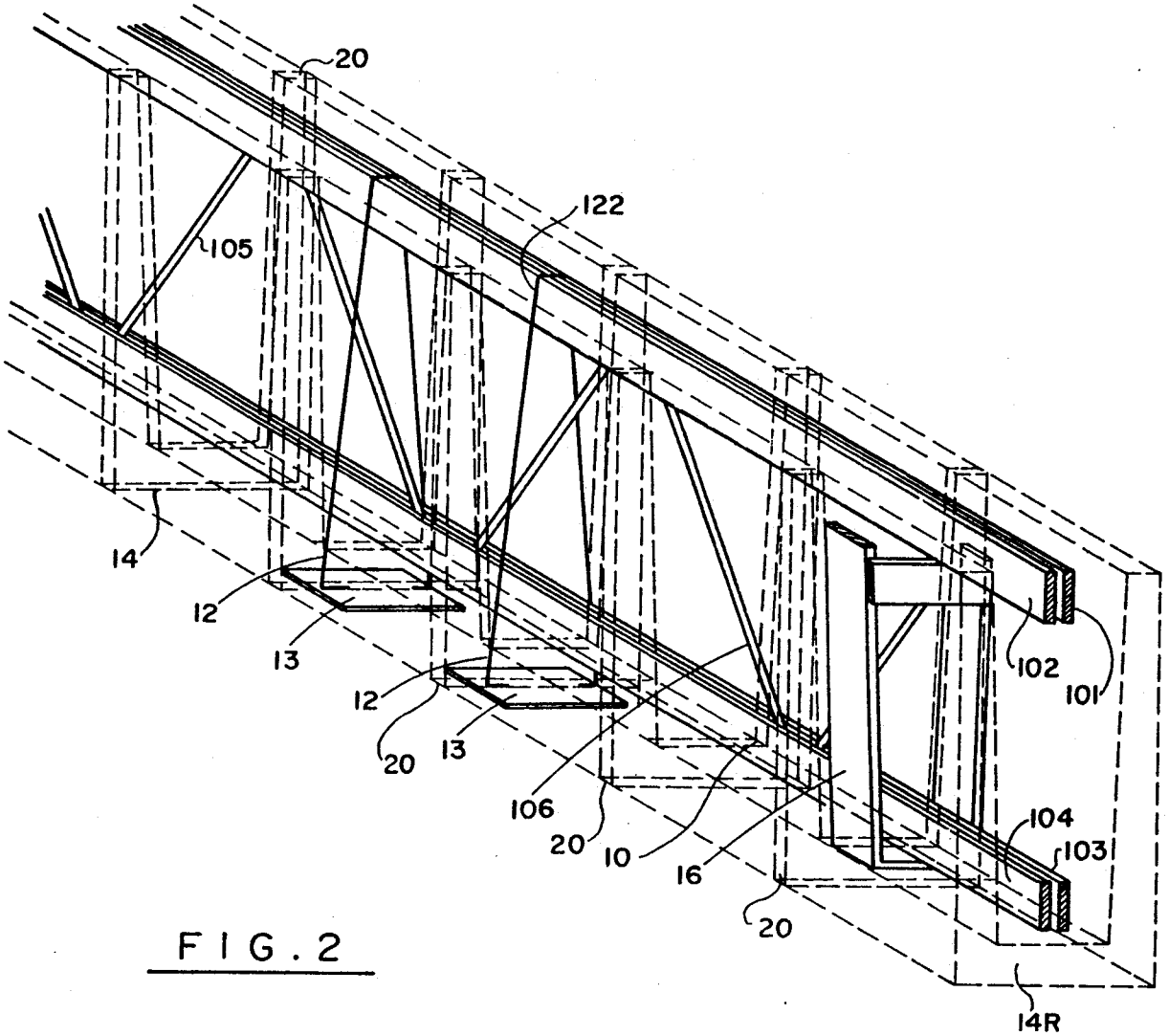
FIG. 2 is an isometric view of the preferred embodiment of the apparatus of the present invention in the direction of arrows II in FIG. 1.
Figure 3:
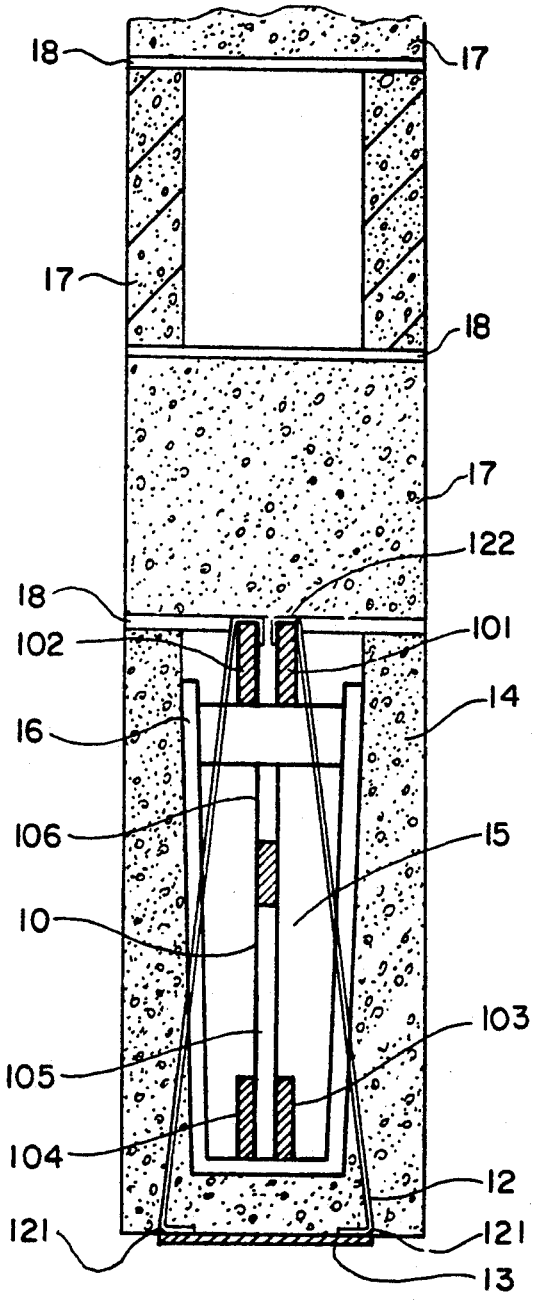
FIG. 3 is a cutaway view of the preferred embodiment of the apparatus of the present invention, taken in the direction indicated by arrows III in FIG. 1.
Figure 4:
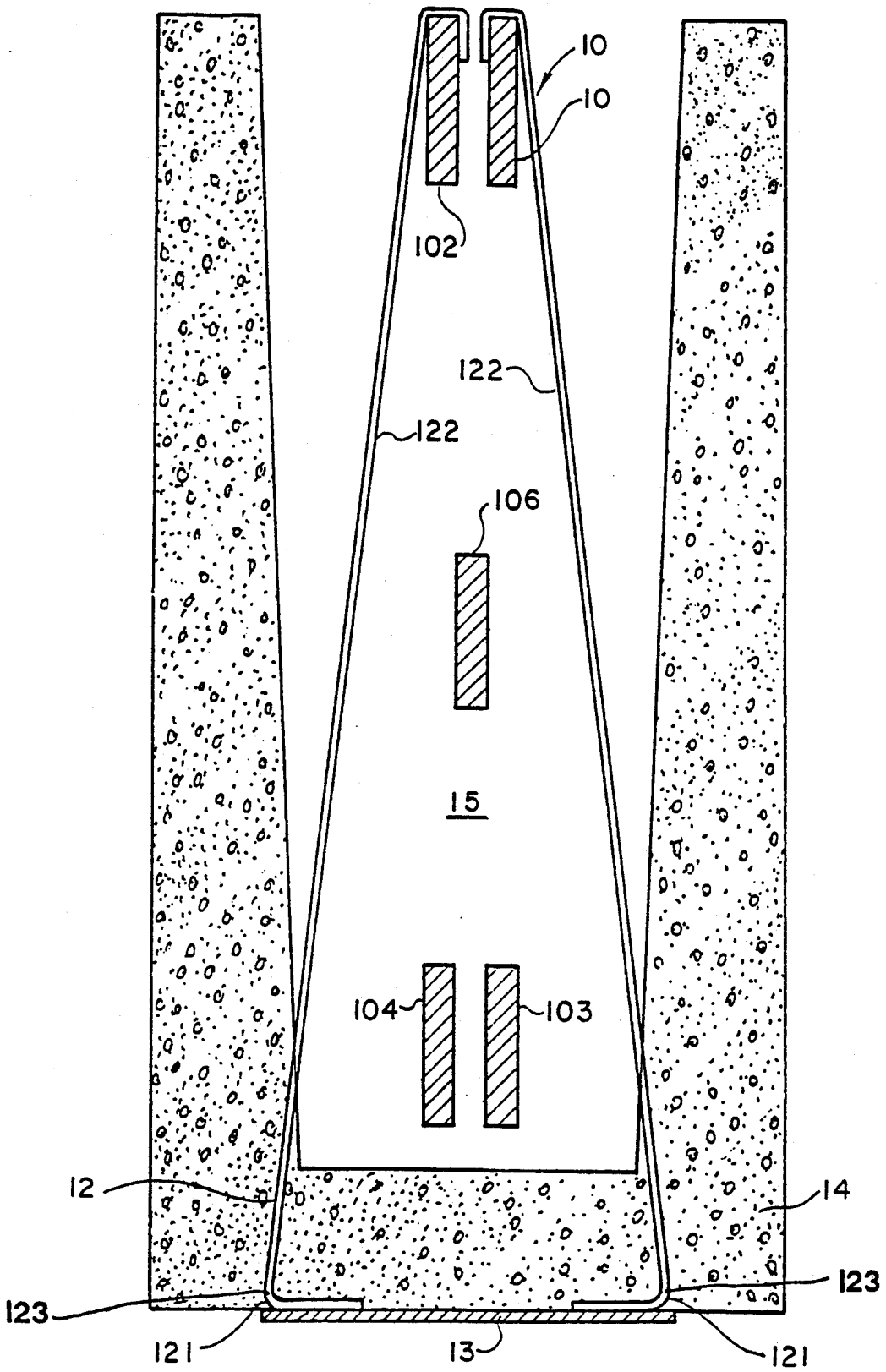
FIG. 4 is a cross-sectional view of the preferred embodiment of the apparatus of the present invention, taken in the direction indicated by arrows IV in FIG. 1.
Figure 5:
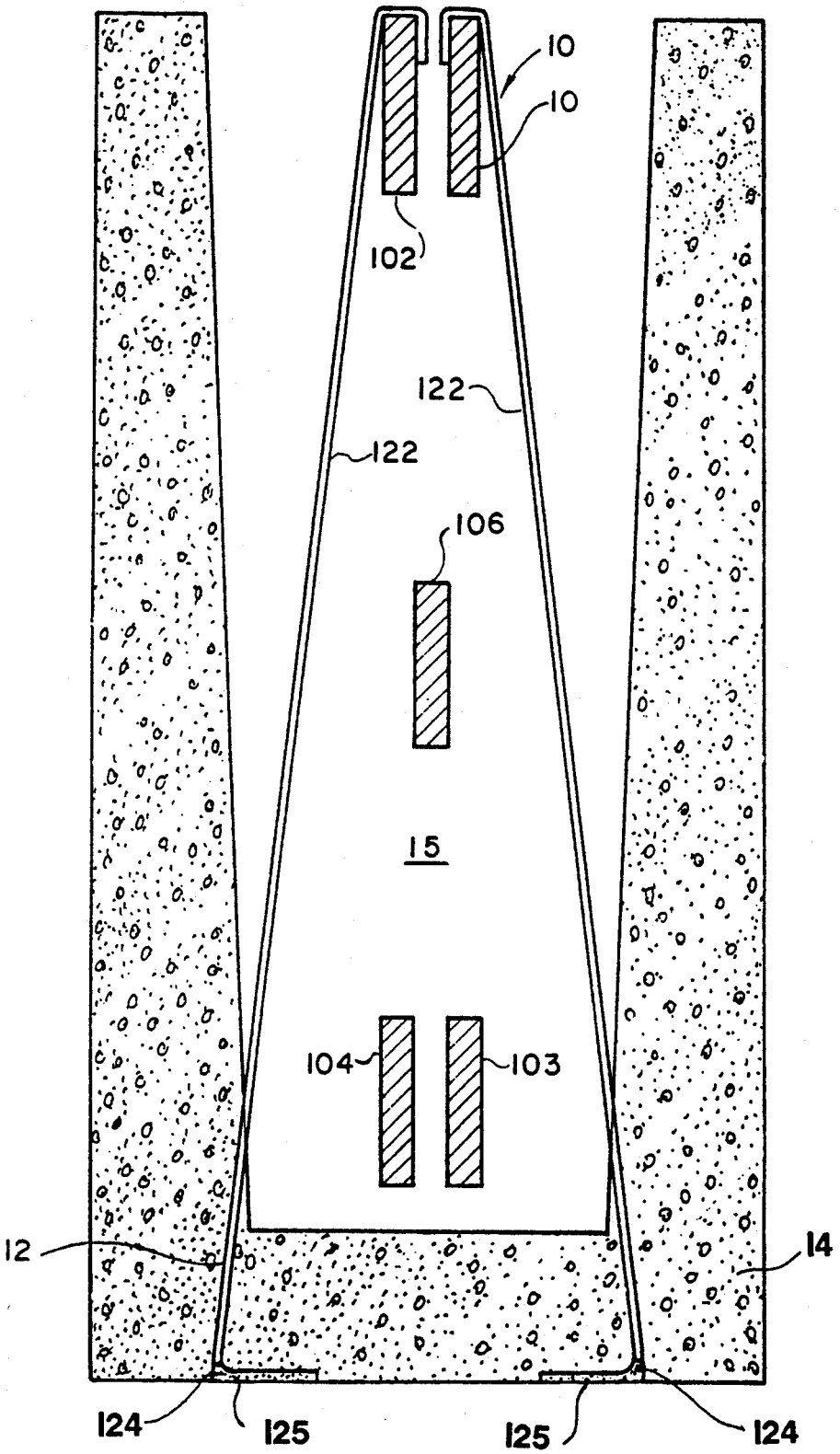
FIG. 5 is a view, similar to FIG. 4, showing mortar filling the holes formed when the bearing surface members are pulled off.

FIGS. 1 through 4 illustrate the preferred embodiment of the apparatus of the present invention.

A truss 10 is placed across an opening 11 in a load-bearing CMU wall 111. Truss 10 includes a right upper chord 101, a left upper chord 102, a right lower chord 103, a left lower chord 104, a plurality of right-slanting diagonal web members 105, and a plurality of left-slanting diagonal web members 106. Connecting web members 105 and 106 serve to connect the upper chords 101, 102 together, to connect the lower chords 103, 104 together, and to connect the upper chords 101, 102 to the lower chords 103, 104.

Truss 10 has a first end and a second end, with a first alignment saddle 16 attached adjacent the first end thereof and a second alignment saddle 16 attached adjacent the second end thereof. Saddles 16 are shaped to fit the interior of concrete U-blocks 14, and serve to center truss 10 laterally in the hollow area 15 of concrete U-blocks 14 when truss 10 is placed in the U-blocks 14L and 1R resting on the left side portion 112 and the right side portion 113, respectively, of wall 111 (U-blocks 14L and 14R are placed on the left side portion 112 and the right side portion 113, respectively, of wall 111 before truss 10 is placed in these blocks; the two rows of CMUs, level with U-blocks 14L and 14R, shown in FIG. 1 can be laid before or after truss 10 is placed in blocks 14L and 14R, but preferably before to make blocks 14L and 14R more stable).

Steel truss 10 spanning opening 11 in load-bearing CMU wall 111 is used as a structural support from which to hang hangers 12 having bearing surfaces 13 on their lower ends. A plurality of movable hangers 12 rest on upper chords 101, 102 of truss 10, each hanger comprising two substantially hook-shaped members 122 attached (such as by welding) at their lower ends to a bearing surface member 13. Resting on the bearing surface member 13 of each hanger 12 are two U-blocks 14. U-blocks 14 are placed on the hangers, and the space 20 between adjacent U-blocks 14 is filled with mortar. After the mortar hardens (typically 24 hours later), the trench formed by the hollow areas 15 in the U-blocks is filled with concrete, thus encasing truss 10 (the height of the truss is less than the distance from the lower interior of the U-blocks 14 to the bottom of the CMUs 17 in the first course above the U-blocks 14) and forming a steel-reinforced structural beam across opening 11. CMUs 17 are then laid on top of this structural beam to continue load-bearing wall 111 above and over opening 11, with mortar 18 being used to bond adjacent CMUs together and to U-blocks 14.

Bearing surfaces 13 are then pried off, preferably breaking hangers 12 above bends 121 in hangers 12 (hangers 12 can be scored, as at scores 123 (see FIG. 4), or otherwise made weaker above bends 121 to allow hangers 12 to break above bends 121 when bearing surfaces 13 are pried off). The holes 124 which are formed when hangers 12 are broken are filled with mortar 125. Thus, the final structure has no exposed steel. As an option, to be decided after consideration of the design of the building in which the truss 10 is installed, the bearing surfaces 13 may remain and may be painted or made decorative in design.

Instead of steel, truss 10 could be made of fiberglass, structural plastic, or structural composite materials.

Truss 10 could be replaced with any truss or truss means strong enough to hold up a course of U-blocks 14 in a desired position above opening 11.

The foregoing embodiments are presented by way of example only; the scope of the present invention is to be limited only by the following claims.

I claim:

1. Apparatus spanning openings in masonry walls, comprising:

(a) a truss means having first and second ends and a height not substantially greater than the distance between the lower interior of a U-block and the upper surface of a U-block; and (b) hanging means, hanging on the truss means, being shaped to receive U-blocks thereon; and (c) a plurality of U-blocks, each U-block having a lower interior, an open upper end, and an upper surface, the U-blocks being received on the hanging means.

2. The apparatus of claim 1, wherein the masonry wall is load-bearing.

3. The apparatus of claim 1, wherein:

the truss means comprises a truss, and the hanging means comprises a plurality of hangers.

4. The apparatus of claim 1, wherein the hanging means are hanging on the truss means and the U-blocks are received on the hanging means, and further comprising:

(d) mortar placed between adjacent U-blocks to form a trench.

5. The apparatus of claim 4, further comprising:

(e) concrete filling the trench and encasing the truss means.

6. The apparatus of claim 1, wherein:

the masonry wall is made of concrete masonry units (CMUs);

the truss means comprises a truss comprising:

(i) left and right lower chords, (ii) left and right upper chords with diagonal connecting web members connecting the upper chords together, the lower chords together, and connecting the upper chords to the lower chords;

the apparatus further comprises:

a first saddle attached at the first end of the truss for placement in a first U-block, and a second saddle attached at the second end of the truss for placement in a second U-block, the saddles being shaped to center the truss laterally in the U-blocks when the truss is placed in the U-blocks; and the hanging means comprises:

a plurality of hangers for hanging on the truss, the hangers comprising two substantially hook-shaped members attached at their lower ends to a bearing surface member, the bearing surface members being shaped to receive the U-blocks thereon.

7. The apparatus of claim 6, wherein the plurality of hangers hang on the upper chords of the truss.

8. The apparatus of claim 6, wherein the two substantially hook-shaped members are attached by welding to the bearing surface member.

9. The apparatus of claim 6, wherein the apparatus is made of steel.

10. The apparatus of claim 1 wherein:

the truss means comprises a truss comprising:

(i) left and right lower chords, (ii) left and right upper chords with diagonal connecting web members connecting the upper chords together, the lower chords together, and connecting the upper chords to the lower chords.

11. The apparatus of claim 10, further comprising:

a first saddle attached at the first end of the truss for placement in a first U-block;

a second saddle attached at the second end of the truss for placement in a second U-block, the saddles being shaped to center the truss laterally in the U-blocks when the truss is placed in the U-blocks.

12. The apparatus of claim 11, wherein the hanging means comprises:

a plurality of hangers, for hanging on the truss, each hanger comprising two substantially hook-shaped members attached at their lower ends to a bearing surface member, the bearing surface members being shaped to receive U-blocks thereon.

13. The apparatus of claim 12, wherein the plurality of hangers hang on the chords of the truss.

14. The apparatus of claim 13, wherein the plurality of hangers hang on the upper chords of the truss.

15. The apparatus of claim 12, wherein the two substantially hook-shaped members are attached by welding to the bearing surface member.

16. Apparatus spanning openings in masonry walls having a left wall portion of masonry built to a desired height of an opening and a right wall portion of masonry built to the desired height of the opening, the apparatus comprising:

(a) a truss means spanning the opening;

(b) hanger means hanging on the truss means;

(c) U-blocks hanging over the opening on the hanger means; and (d) mortar placed between adjacent U-blocks so that the U-blocks and the mortar together form a trench.

17. The apparatus of claim 16, further comprising:

a first U-block placed on the left wall portion such that the right side of the first U-block is substantially flush with the right side of the left wall portion; and a second U-block placed on the right wall portion such that the left side of the second U-block is substantially flush with the left side of the right wall portion;

wherein the truss means comprises a truss having first and second ends and having a height less than the distance between the lower interior of a U-block and the lower surface of a CMU in a course immediately above the opening, the truss comprising left and right lower chords, left and right upper chords with diagonal connecting web members connecting the upper chords together, the lower chords together, and connecting the upper chords to the lower chords, and having a first saddle attached at the first end thereof for placement in the first U-block and a second saddle attached at the second end thereof for placement in the second U-block, the saddles being shaped to center the truss laterally in the U-blocks when the truss is placed in the U-blocks.

18. The apparatus of claim 16, further comprising:

mortar filling holes formed in the lower surface of the trench when bearing surface members, used to temporarily hold the U-blocks while the mortar between the U-blocks is drying, are pried off.

19. The apparatus of claim 16, wherein the hanger means include a plurality of hangers each comprising two substantially hook-shaped members attached at their lower ends to a bearing surface member, the hook members being attached to the truss means, the bearing surface members being shaped to receive U-blocks thereon.

20. The apparatus of claim 16, wherein the masonry wall is a load-bearing wall.

21. The apparatus of claim 16, wherein:

each U-block has a lower interior, an open upper end, and an upper surface; and the truss means has first and second ends and a height not substantially greater than the distance between the lower interior of a U-block and the upper surface of a U-block.

22. The apparatus of claim 16, further comprising concrete filling the trench and encasing the truss means.

23. The apparatus of claim 22, wherein the hanger means include a plurality of hangers each comprising two substantially hook-shaped members attached at their lower ends to a bearing surface member, the hook members being attached to the truss means, the bearing surface members being shaped to receive U-blocks thereon.

24. Apparatus spanning openings in masonry walls made of concrete masonry units (CMUs) and comprising a left wall portion of CMUs built to a desired height of an opening and a right wall portion of CMUs built to the desired height of the opening, the apparatus comprising:

(a) a first U-block placed on the left wall portion such that the right side of the first U-block is substantially flush with the right side of the left wall portion;

(b) a second U-block placed on the right wall portion such that the left side of the second U-block is substantially flush with the left side of the right wall portion;

(c) a truss placed across the opening, the truss having first and second ends and a height less than the distance between the lower interior of a U-block and the lower surface of a CMU in a course immediately above the opening, the truss comprising left and right lower chords, left and right upper chords with diagonal connecting members connecting the upper chords together, the lower chords together, and connecting the upper chords to the lower chords, and having a first saddle attached at the first end thereof for placement in the first U-block and a second saddle attached at the second end thereof for placement in the second U-block, the saddles being shaped to center the truss laterally in the U-blocks when the truss is placed in the U-blocks;

(d) a plurality of hangers hanging on the upper chords of the truss, the hangers comprising two substantially hook-shaped members attached at their lower ends to a bearing surface member;

(e) U-blocks hanging over the opening on the bearing surface members;

(f) mortar placed between adjacent U-blocks, the mortar and U-blocks together forming a trench; and (g) concrete filling the trench and encasing the truss.

25. The apparatus of claim 24, wherein the masonry wall is a load-bearing wall.

* * * * *